US005242285A

United States Patent [19]

Westermann, Jr.

[11] Patent Number: 5,242,285

[45] Date of Patent: Sep. 7, 1993

[54] CRYOGENIC VANE PUMP

[75] Inventor: Phillip J. Westermann, Jr., El Toro, Calif.

[73] Assignee: ACD, Inc., Santa Ana, Calif.

[21] Appl. No.: 449,535

[22] Filed: Dec. 12, 1989

[51] Int. Cl.[5] ..... F04C 2/344; F04C 13/00

[52] U.S. Cl. ..... 418/111; 418/268; 62/50.6

[58] Field of Search ..... 418/111, 259, 268, 150, 418/267; 62/50.6

[56] References Cited

U.S. PATENT DOCUMENTS

| | | | |
|---|---|---|---|
| 888,779 | 5/1908 | Berrenberg | 418/259 |
| 1,972,744 | 9/1934 | Lister | 418/111 |
| 3,255,704 | 6/1966 | Mazur | 418/268 |

FOREIGN PATENT DOCUMENTS

| | | | |
|---|---|---|---|
| 778346 | 12/1934 | France | 418/111 |
| 62-78489 | 4/1987 | Japan | 418/259 |
| 960080 | 6/1964 | United Kingdom | 418/111 |

*Primary Examiner*—John J. Vrablik

*Attorney, Agent, or Firm*—Harold L. Jackson

[57] ABSTRACT

A vane pump particularly adapted for pumping cryogenic liquids has a plurality of vanes, each of which comprises a composite of at least two vane plates mounted in slots of a rotor of the pump, and sealingly pressed toward one another by the pressure differential existing on the opposite sides of the vanes, while the vanes are under pumping load. Each plate of the vanes comprises at least two parts which are mounted to one another and incorporate a biasing device, such as a spring, which urges the parts away from one another in a direction substantially parallel with the rotational axis of the rotor, and into sealing relationship with the end walls of a stator chamber in which the rotor is rotating. As an additional feature, the interior surface of the stator chamber, has a circular cross section in the area where the vanes move under a pumping load. The circle of this cross section is concentric with the rotor, so that under pumping load the vanes do not move in or out of slots into which they are mounted in the rotor. Good sealing ability and low friction of operation are attained by the vane pump of the disclosure.

12 Claims, 3 Drawing Sheets 54
52
54
54
48
54
54
52

54
66
54
68
62
64
60
58
52

CRYOGENIC VANE PUMP

BACKGROUND OF THE INVENTION

1. Field of the Invention

The present invention is directed to a vane pump. More particularly, the present invention is directed to a vane pump which is especially adapted for pumping cryogenic liquids.

2. Brief Description of Prior Art

Vane pumps adapted for pumping fluids, particularly liquids, have been known for a long time. As is known in the art, vane pumps comprise a particular type or class of positive displacement pumps and have a non-rotating stator housing which forms a chamber, and a rotor which is eccentrically placed in the housing to rotate therein. A plurality of vanes are mounted for in-and-out sliding movement, substantially in the radial direction. The vanes stay in contact with the interior wall of the chamber and force the fluid (usually liquid) to flow from an inlet port towards an outlet port. Problems which various constructions of vane pumps strive to solve relate to movement of the vanes within the slots formed in the rotor, friction generated between the vanes and the stator housing, and the quality of the seal formed between the vanes and the stator housing. Generally speaking, as it will be well appreciated by those skilled in the art, friction between the vanes and the stator is undesirable, an effective seal between the vanes and the stator housing is desirable, and ideally the vanes should move in-and-out of their respective slots in the rotor with minimum hindrance and friction. U.S. Pat. Nos. 3,988,083, 3,955,540, 4,451,219, 4,184,821, 4,299,546, 4,410,305, 4,209,286, 4,225,295, 4,212,603, 870,290, 118,993, 1,952,142, 4,088,426, 4,253,809, 2,672,282, British Patent Specification No. 259,346, and German Patent Nos. 455,476, 458,384, exemplify various approaches of the prior art to rotary vane pumps, rotary vane compressors and related devices (such as rotary engines), which attempt to accomplish the above-noted goals.

Rotary vane pumps used for pumping cryogenic liquids must, generally speaking, meet more exacting requirements than vane pumps used in other applications. As is known, cryogenic liquids, such as liquefied hydrogen, liquefied nitrogen and liquefied helium are extremely cold, lack substantial lubricating qualities, and have low viscosity. Extreme cold temperature usually generates a problem in the operation of any mechanical device. This problem is exacerbated in vane pumps for cryogenic liquids where the lack of lubricity of the pumped cold liquid causes additional problems of friction, and where input of heat generated by friction is particularly undesirable. Moreover, the low viscosity of the pumped cryogenic liquids permits significant leakage through relatively small openings, and therefore, for efficient operation particularly effective seals would be required. The present invention provides a vane pump especially suited for pumping cryogenic liquids which is designed to address and overcome or alleviate the above-noted problems.

SUMMARY OF THE INVENTION

It is an object of the present invention to provide a vane pump which is specifically adapted for and is highly suitable for pumping cryogenic liquids.

It is another object of the present invention to provide a vane pump for pumping cryogenic liquids and other fluids where the vanes provide good sealing action against a stator housing.

It is still another object of the present invention to provide a vane pump for pumping cryogenic liquids and other fluids wherein the vanes, end plates, and the stator housing jointly form an effective seal against the pumped liquid leaking from a high pressure zone in the pumping chamber back into the low pressure zone in the pumping chamber.

It is yet another object of the present invention to provide a vane pump for pumping cryogenic liquids and other fluids wherein friction and wear generated by the vanes is minimized.

It is still a further object of the present invention to provide a vane pump for pumping cryogenic liquids and other fluids wherein under pumping load the vanes do not undergo sliding motion relative to the rotor in which they are mounted.

The foregoing and other objects and advantages are attained by a vane pump which has a stator housing including an inner surface which, together with two substantially oppositely disposed end plates, defines a stator chamber. The stator housing also includes fluid inlet and outlet ports into the chamber. A rotor is rotatably mounted within the chamber for rotation about a rotor axis which is substantially perpendicular to the end plates. The rotor has a plurality of slots, each of which is adapted to slidably receive a vane. A plurality of vanes are mounted to the rotor, with each vane being disposed in one slot of the rotor and comprising a plurality of vane plates. The plates of each vane are positioned in the slot substantially parallel with the other plate and the plates are adjacent to one another and collectively substantially fill the slot. Each plate of each vane further comprises at least two parts disposed in substantially adjacent relationship to one another. Biasing means, such as springs, are mounted to each plate of each vane for biasing the parts of each plate slightly away from one another in a direction substantially parallel with the rotational axis of the rotor and into contact with the end plates, whereby the vanes form an effective seal against the end plates, and whereby during rotation of the rotor, pressure differential on two sides of each vane causes the plates of each vane to be pressed towards one another forming an effective seal against leakage of fluid from high pressure zones back into low pressure zones within the pump.

As an additional feature, the inner curved surface of the stator housing includes a first surface of substantially circular curvature which is disposed to be in contact with the vanes while the vanes are traveling under pumping load. The center of the circular curvature of the first surface is the same as the center of rotation of the rotor whereby under pumping load the vanes travel only in a substantially circular arc. Consequently, under pumping load the vanes do not slide in their respective slots in the rotor thereby achieving improved seal against leakage of pumped liquid from high pressure zones back into low pressure zones within the pump.

The features of the present invention can be best understood together with further objects and advantages by reference to the following description, taken in connection with the accompanying drawings, wherein like numerals indicate like parts.

DESCRIPTION OF THE PREFERRED EMBODIMENT

Figure 1:
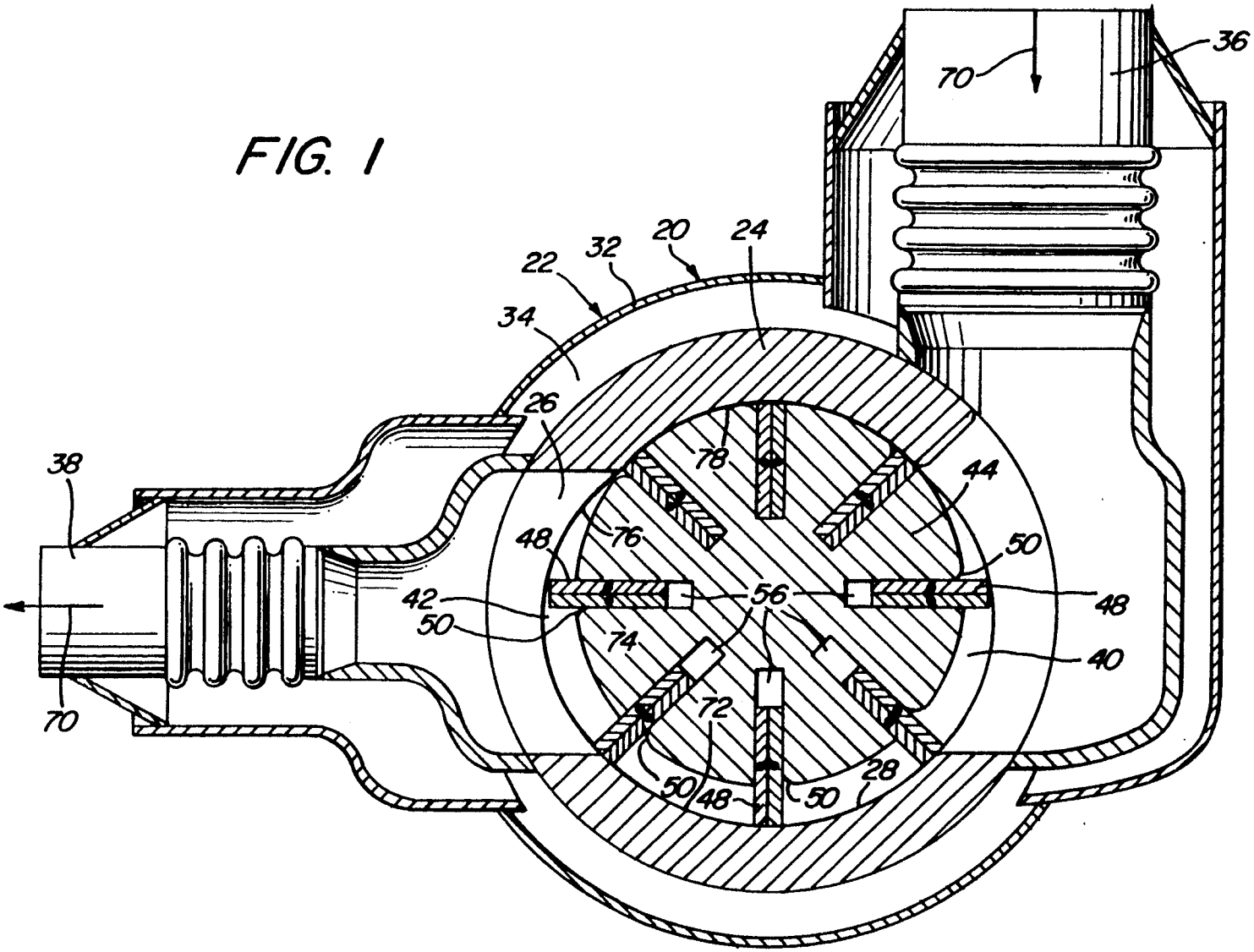
FIG. 1 is a cross-sectional view of a preferred embodiment of the vane pump of the present invention.

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing Figures, a preferred embodiment 20 of the vane pump of the present invention is disclosed. In accordance with the objectives of the present invention (which have been stated in the introductory sections of the present application for United States Letters Patent) the vane pump of the invention is specially designed and adapted for pumping cryogenic liquids, such as liquid hydrogen, liquid nitrogen and liquid helium. As it was noted above, cryogenic liquids, such as the above-named liquids, not only create an extremely cold working environment for the pump, but also lack lubricity and have very low viscosity thereby exacerbating problems of friction, undesirable input of heat generated by friction, and leakage. The below described vane pump of the invention is designed to operate efficiently for pumping cryogenic liquids in spite of these adverse conditions, and therefore the pump of the invention described herein, is referred to primarily as a vane pump for cryogenic liquids. Nevertheless, it should be understood that the pump of the present invention is suitable for pumping virtually all types of fluids, and can be particularly advantageously used for pumping liquids of low viscosity and/or low lubricity, where, due to the low viscosity and lubricity of the pumped liquid, significant problems of leakage and friction would normally arise with vane pumps of the prior art.

Returning now to the description of the preferred embodiment of the vane pump 20 in connection with the drawing Figures, the pump 20 includes a housing 22 having a structural member 24 which forms a stator chamber 26 with an interior curved surface 28. The configuration of the interior curved surface 28 forms a significant novel aspect of the present invention and is described in detail below. The curved surface 28 is also called a quasi-cylindrical surface 28. The housing 22 includes two end plates 30 which are disposed at opposite ends of the housing 22 and which, together with the quasi-cylindrical surface 28, form the stator chamber 26. The housing 22 further includes an outer housing wall 32, and a chamber 34 is formed between the structural member 24 (the interior of which forms the quasi-cylindrical surface 28) and the outer housing wall 32. Air is evacuated from the chamber 34, so that the resulting "vacuum filled" space acts as a thermal insulator, which is highly desirable when the pump 20 is utilized for pumping cryogenic liquids (not shown).

The housing 22 also includes an inlet duct 36 and an outlet duct 38, which lead to corresponding inlet 40 and outlet 42 ports formed in the structural member 24. As is shown in FIG. 1, the insulating chamber 34 is disposed extended over the inlet 36 and outlet 38 ducts as well, to thermally insulate the flow of cryogenic liquid (not shown) in these ducts 36 and 38.

Figure 2:
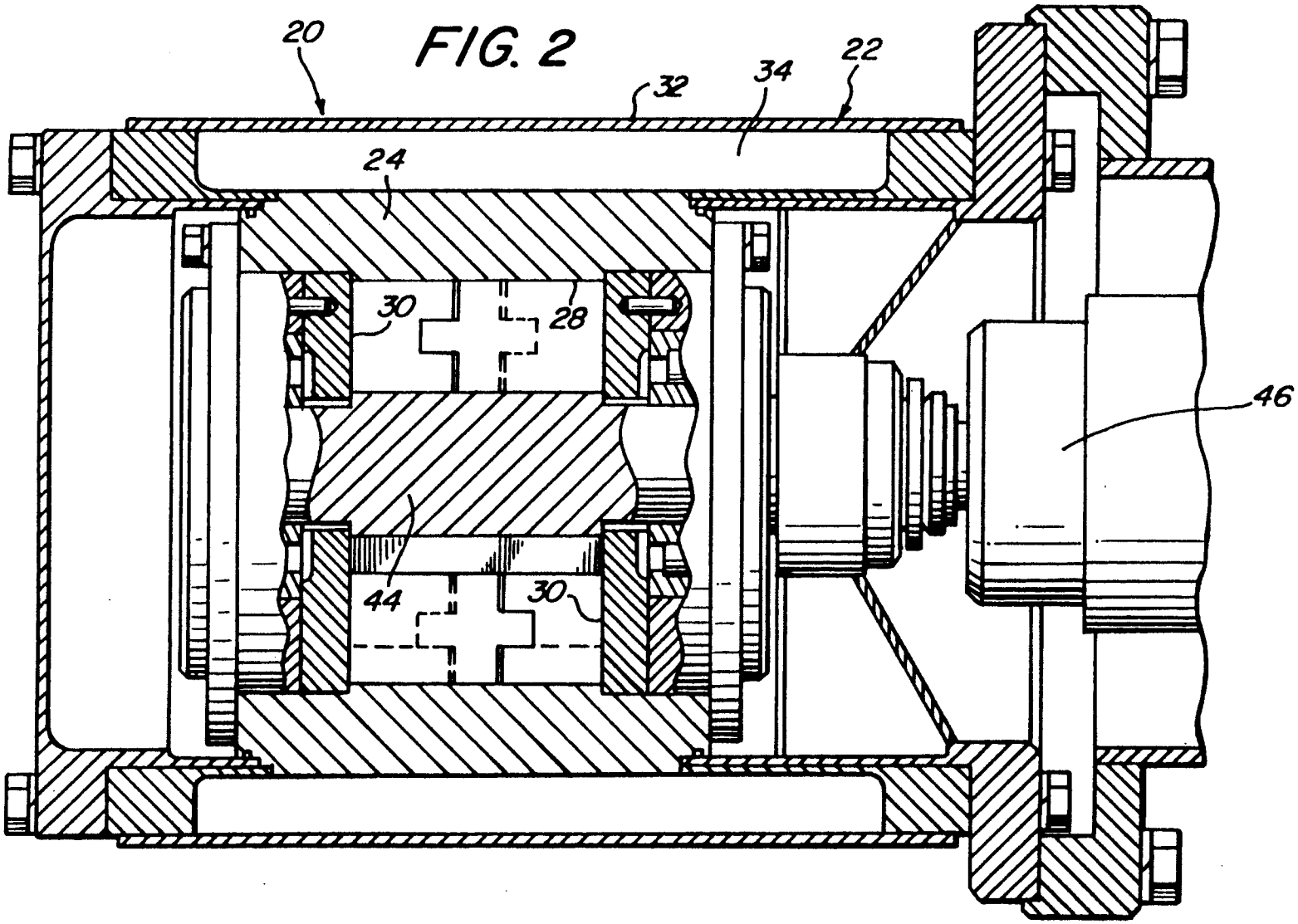
FIG. 2 is another cross-sectional view of the preferred embodiment of the vane pump of the present invention.

A rotor 44 is mounted in the stator chamber 26 and is driven by an electric motor 46 which is schematically shown on FIG. 2 of the appended drawings. The motor 46 is of conventional construction and need not be described further. Similarly, bearings (not shown) which rotatably support the rotor 44 may be of conventional construction and need not be described here further. The entire housing 22 of the preferred embodiment 20 is made from steel, preferably from austenitic stainless steel, although other known materials suitable for low temperature applications, may also be used. The rotor 44 and the structural member 24 which forms the interior stator chamber 26 are formed by machining, preferably by a process known as wire electro-discharge machining.

A plurality of vanes 48 are mounted into slots 50 formed in the rotor 44. In this regard it is noted that the number of vanes 48 is not critical from the standpoint of the present invention, although as in all vane pumps, at least two vanes are required. Preferably, as is shown in the appended drawings the preferred embodiment of the vane pump 20 of the present invention has eight (8) vanes. As is known by those familiar with the operation of vane pumps, a reasonably large number of vanes (such as eight vanes) reduces or eliminates an undesirable pulsating effect in the operation of the pump. The materials from which the vanes 48 of the present invention are made are not critical; the vanes 48 can be made of metals or of plastics capable of withstanding cryogenic temperatures. Polytetrafluoro ethylene (Teflon®), fiber reinforced polytetrafluoro ethylene, and more particularly glass fiber reinforced polytetrafluoro ethylene, are specially suitable materials for the construction of the vanes 48. The vanes 48 can also be made from polytetrafluoro ethylene coated metal.

Figure 3:
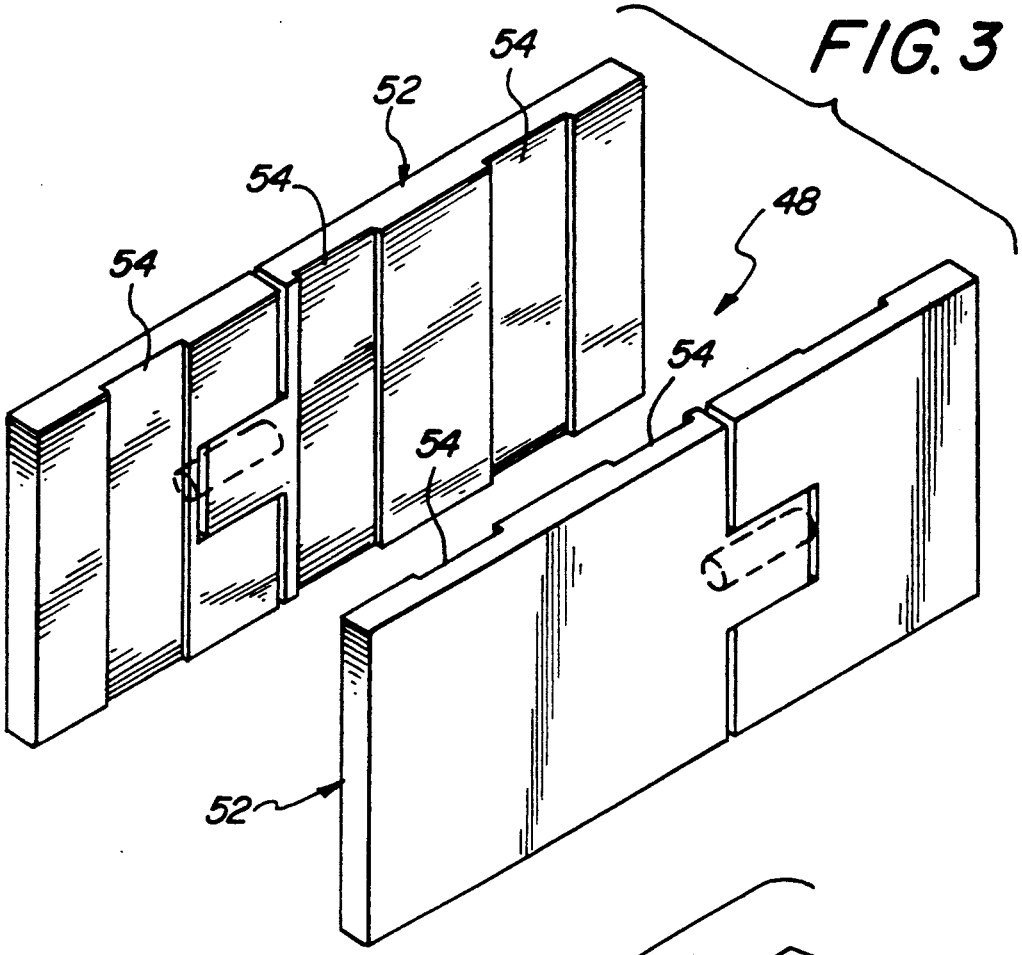
FIG. 3 is a partially exploded perspective view of a single vane incorporated in the preferred embodiment of the vane pump of the present invention.
Figure 4:
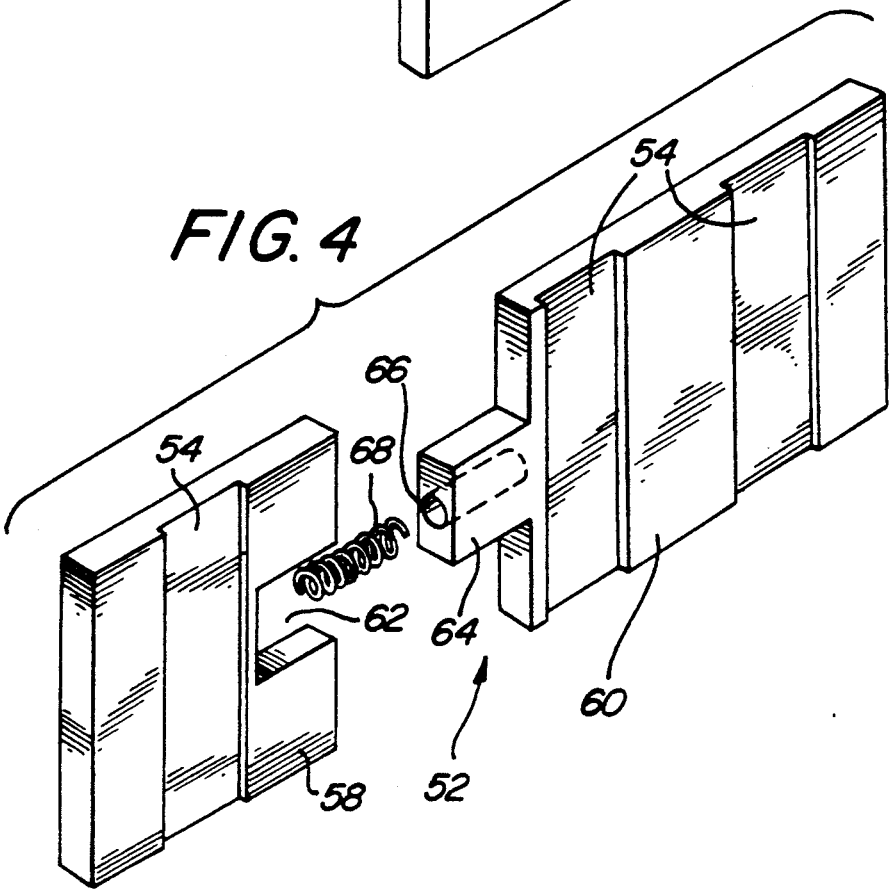
FIG. 4 is an exploded perspective view of a vane plate comprising one half of a single vane incorporated in the preferred embodiment of the vane pump of the present invention.

The exploded perspective views of FIGS. 3 and 4 disclose in detail the configuration and construction of the vanes 48, which comprise an important novel aspect of the present invention. Thus, in accordance with the invention each vane 48 is constructed from several components so that under pumping load the pressure differentials on the high pressure and low pressure sides of the vane cause the components to be tightly pressed against one another and thereby to form an effective seal against leakage from the high pressure side to the low pressure side. Moreover, a biasing force arising from a spring or the like, acts upon the components in a direction substantially parallel with the rotational axis of the rotor 44, to cause the components to seal effectively against the end plates 30. This is explained further with reference to the vanes 48 of the preferred embodiment as follows.

Each vane 48, shown on FIG. 3, is made of two vane plates 52, which in the preferred embodiment are substantially identical, in the sense that the two plates 52 comprise symmetrical mirror images of one another. The substantially rectangular vane plates 52 include a plurality of channels or grooves 54. When the two plates 52 of each vane 48 are assembled and mounted in the respective slot 50 of the rotor 44, the channels or grooves 54 form a fluid conduit through the body of each vane 48. In this regard it is noted that on FIGS. 3 and 4 the long axis of the vane plates 52 is disposed in the direction parallel with the rotational axis of the rotor 44 (when the vane plates 52 are properly placed in the pump 20 of the invention) and the short axis is disposed in the radial, or substantially radial direction. Thus, the grooves 54 are disposed in the radial or substantially radial direction and thereby form conduits through which liquid can flow substantially unimpeded in-and-out of the slot 50 of the rotor 44 into which the respective vane 48 is mounted. Empty space in the slots 50 below the vanes 48 is indicated with the reference numeral 56 on FIG. 1. As it will be readily appreciated by those skilled in the art during operation of the pump 20 the space 56 is filled with liquid, and there must be fluid communication of the pumped liquid (not shown) into and out of the space 56 in order to permit in-and-out sliding movement of the vanes 48 in the slots 50.

The exploded perspective view of a single vane plate 52 depicted on FIG. 4 discloses that each vane plate 52 comprises two parts 58 and 60 and that the two parts are assembled to one another so as to be able to move away slightly from one another in a direction substantially parallel with the rotational axis of the rotor 44. To this end, in the preferred embodiment the first part 58 has a square shaped opening or window 62, and the second part 60 has a square shaped protrusion 64 complementary to the window 62. The protrusion 64 includes an aperture 66 which houses a coil spring 68. The coil spring 68 acts as biasing means for biasing the two parts 58 and 60 away from one another and into sealing relationship with the interior end plates 30 of the housing 22.

Thus, in accordance with the foregoing, four component parts, specifically two plates 52, each of which has two parts 58 and 60, plus the coil spring 68 are assembled to form each vane 48. During operation of the pump 20, pressure differential on the two sides of the vanes 48, while under pumping load, presses the two plates 52 to one another.

The number of plates 52 and parts (such as 58 and 60) forming each plate 52 are not critical in accordance with the invention, as long as the above-described functions are performed. Thus, more than two plates may be provided to be pressed together in a "sandwich" like manner to prevent leakage from the high pressure side to the low pressure side. Moreover, more than two parts may be provided in accordance with the invention to form each vane plate 52 to be biased against the end plates 30 of the housing 22 for effective sealing engagement therewith.

Referring now again primarily to FIG. 1, the interior curved surface of the 28 formed by the structural member 24 of the housing 22 is described in detail. As it was noted above, the shape or configuration of this surface 28 forms a significant novel aspect of the cryogenic vane pump 20 of the present invention.

Having specific reference now to FIG. 1, travel of the vanes 48 carried by the rotating rotor 44 within the stator chamber 26 is illustrated. The Figure depicts the vane pump 20 with the rotor 44 rotating in clockwise direction, and the flow of the pumped liquid being shown by the arrows 70. A portion of the inner surface 28 of the chamber 26, which is on the "lower" side of FIG. 1 comprises an area 72 where the vanes 48 are under pumping load. As a novel feature of the invention, in the area 72 of "pumping load" the cross-section of the curved surface is a circle which is concentric with the center of rotation of the rotor 44. Radius of this circle, however, is larger than the radius of the rotor 44, so that in the area of pumping load 72 centrifugal force causes the vanes 48 to extend from their respective slots 50 and to come into sealing engagement with the interior surface of cylindrical curvature 28. What is important in this regard is, that because the surface 28 is of circular or substantially circular cross-section, under pumping load the vanes 48 do not travel with relation to the slots 50, and that sliding motion of the vanes 48 in the slots 50 occurs only when the vanes 48 are not under pumping load. In a typical vane pump constructed as a preferred embodiment of the present invention, the circular radius of the area of pumping load 72 is approximately ½ inch larger than the radius of the rotor 44. Such a typical, exemplary pump of the preferred embodiment, is designed to pump approximately 200 gallons of cryogenic liquid (such as liquid hydrogen) per minute, and the output pressure may be as high as 400 PSI.

Following now rotation of the rotor 44 in a clockwise direction, in the area 74 of the outlet port 42, the interior curved surface 28 comprises another circular arc, this second arc being of a smaller radius than the arc of the area of the pumping load 72. Still further, in the direction of the clockwise rotation of the rotor 44, the interior curved surface 28 of the preferred embodiment 20 has a relatively short portion 76 which is a straight line in cross section. This is followed by an area 78 where the cross section is again an arc of a circle concentric with the rotor 44, but of a radius which causes the vanes 48 to be substantially fully inserted into their respective slots 50. The interior surface 28 of the preferred embodiment 20 is symmetrical from left to right (as depicted in FIG. 1) in all relevant aspects, so that further description of this surface is not necessary. As it should be apparent from the foregoing description to those skilled in the art, there are advantages of providing the area 72 where the vanes 48 do not travel in or out of the slots 50 under pumping load. These advantages include better sealing ability, and avoidance of heat and wear which would otherwise be generated (in accordance with the prior art) by the friction of the vanes 48 moving in the slots 50 under pumping load.

Several modification of the above-described invention may become readily apparent to those skilled in the art in light of the foregoing disclosure. Therefore, the scope of the present invention should be interpreted solely from the following claims, as such claims are fairly read in light of the disclosure.

What is claimed is:

1. A vane pump for pumping cryogenic liquids, the vane pump comprising:

a stator housing having an inner surface which defines a stator chamber including two end plates disposed at opposite ends of the stator chamber, the stator housing further having fluid inlet and outlet ports into the chamber, a rotor rotatably mounted within the chamber for rotation about a rotor axis which is substantially perpendicular to the end plates, the rotor having a plurality of slots each of which is adapted to slidably receive a vane;

a plurality of vanes, each vane mounted into one slot of the rotor and each vane comprising a plurality of vane plates, each plate positioned in the slot substantially parallel with the other plate and the plates being adjacent to one another and collectively substantially filling the slot, each plate of each vane comprising at least two parts disposed in substantially adjacent relationship to one another, biasing means mounted to each plate of each vane for biasing the parts of each plate away from one another in a direction substantially parallel with the rotational axis of the rotor and into contact with the end plates whereby the biasing means causes the vanes to seal against the end plates, and whereby during rotation of the rotor, pressure differential on two sides of each vane causes the plates of each vane to be pressed towards one another; and the inner surface of the stator housing which comes into contact with the vanes while the vanes are traveling under a pumping load of cryogenic liquid comprising a first surface of substantially circular curvature extending between said inlet port and said outlet port with the center of the curvature of said surface being substantially coincident with the center of rotation of the rotor, whereby under a pumping load each vane travels only in a substantially circular arc so that the vanes do not move substantially within the rotor slots.

2. The vane pump of claim 1 wherein each vane forms at least one groove which permits fluid communication in the radial direction.

3. The vane pump of claim 2 wherein each vane consists of two vane plates.

4. The vane pump of claim 2 wherein each vane plate consists of two separate parts which are biased away from one another in a direction substantially parallel with the rotational axis of the rotor and into contact with the end plates.

5. The vane pump of claim 3 wherein each vane plate consists of two separate parts which are biased away from one another in a direction substantially parallel with the rotational axis of the rotor and into contact with the end plates.

6. The vane pump of claim 1 wherein the biasing means comprise a coil spring.

7. The vane pump of claim 1 comprising eight vanes.

8. The vane pump of claim 1 wherein the inner surface of the stator chamber includes at least a second surface of substantially circular curvature, and wherein the center of the circular curvature of the second surface is the same as the center of rotation of the rotor, the curvature of the second surface being defined by a radius which is smaller than the radius of curvature of the first surface, the second surface of cylindrical curvature being disposed in an area of the stator chamber where the traveling vanes are not under pumping load.

9. A vane pump for pumping cryogenic liquids, the vane pump comprising:

a stator housing having an inner surface which defines a stator chamber, the inner surface including a curved surface and two end plates disposed at opposite ends of the stator chamber, the stator housing further having fluid inlet and outlet ports into the chamber, a rotor rotatably mounted within the chamber for rotation about a rotor axis which is substantially perpendicular to the end plates, the rotor having a plurality of slots each of which is adapted to slidably receive a vane;

a plurality of vanes, each vane mounted into one slot of the rotor, the ends of the vanes coming into contact with the curved surface of the stator chamber, the curved surface of the stator chamber including at least a first surface of substantially circular curvature extending between said inlet port and said outlet port which is disposed to be in contact with the vanes while the vanes are traveling under cryogenic liquid pumping load and wherein the center of the circular curvature of the first surface is the same as the center of rotation of the rotor whereby under the pumping load the vanes travel only in a substantially circular arc, each vane comprising a plurality of vane plates, each plate positioned in the slot substantially parallel with the other plate and the plates being adjacent to one another and collectively substantially filling the slot, each plate of each vane comprising at least two parts disposed in substantially adjacent relationship to one another, and biasing means mounted to each plate of each vane for biasing the parts of each plate away from one another in a direction substantially parallel with the rotational axis of the rotor and into contact with the end plates whereby the biasing means causes the vanes to seal against the end plates, and whereby during rotation of the rotor pressure differential on two sides of each vane causes the plates of each vane to be pressed towards one another.

10. The vane pump of claim 9 wherein each vane consists of two vane plates, and wherein each vane plate consists of two parts.

11. The vane pump of claim 10 wherein the biasing means comprise springs.

12. The vane pump of claim 11 wherein one part of each vane plate contains a cavity, and wherein the biasing spring is mounted into said cavity.

* * * * *